United States Patent [19]

Landt

[11] Patent Number: 4,459,568

[45] Date of Patent: Jul. 10, 1984

[54] AIR-STRIPLINE OVERLAY HYBRID COUPLER

[75] Inventor: Donnie L. Landt, Marion, Iowa

[73] Assignee: Rockwell International Corporation, El Segundo, Calif.

[21] Appl. No.: 345,189

[22] Filed: Feb. 2, 1982

[51] Int. Cl.[3] ..... H01P 5/18

[52] U.S. Cl. ..... 333/116; 333/238

[58] Field of Search ..... 333/109, 115, 116, 245, 333/238, 246

[56] References Cited

U.S. PATENT DOCUMENTS

| | | | |
|---|---|---|---|
| 2,575,571 | 11/1951 | Wheeler | 333/115 |
| 2,934,719 | 4/1960 | Kyhl | 333/115 |
| 3,140,456 | 7/1964 | Lassen et al. | 333/128 |
| 3,146,413 | 8/1964 | Butler | 333/115 X |
| 3,345,585 | 10/1967 | Hildebrand | 333/116 |
| 3,506,932 | 4/1970 | Beurrier | 333/116 |
| 3,621,478 | 11/1971 | Johnson et al. | 333/116 |
| 4,349,793 | 9/1982 | Spinner | 333/115 X |
| 4,383,226 | 5/1983 | Nygren et al. | 333/238 X |

*Primary Examiner*—Paul L. Gensler

*Attorney, Agent, or Firm*—George A. Montanye; H. Fredrick Hamann

[57] ABSTRACT

A microwave circuit is disclosed which may be employed to form a low loss, high isolation, quadrature coupler operating over a wide frequency range. The coupler includes two quarter-wave transmission lines formed on air-stripline circuit boards and held in close proximity within a housing to provide microwave coupling. The lines are separated by precise spacing elements located between the stripline circuit boards. A plurality of alignment pins retain the stripline boards in exact geometrical position with respect to one another in the coupler configuration. Wave spring washers retained on the alignment pins cooperate with the housing to insure proper board spacing for optimal performance.

11 Claims, 3 Drawing Figures

AIR-STRIPLINE OVERLAY HYBRID COUPLER

BACKGROUND OF THE INVENTION

The present invention relates to microwave circuitry and more particularly to an air-stripline microwave coupler.

Microwave couplers are well known in the art and have been constructed in various configurations generally known as microstrip, stripline, coaxial, and wave guide couplers. Each of the known couplers have their own characteristics and are used in a variety of applications to optimize microwave transmission and coupling. In recent years, there has been an increase in the demand for devices which generate microwave energy over various frequency bands and at higher power levels than previously necessary. As the demand for high power devices has increased, so too has the demand for more efficient, reliable, low cost and compatible transmission lines and couplers. IMPATT diodes, for example, are extensively used for their power generating capabilities in the microwave regions for use in radar and communications systems, and new coupling devices are now required to more effectively use such IMPATT devices.

Naturally, in any power transmission or coupling circuit, it is desirable to couple or transmit energy with as little loss as possible. In many known techniques, coupling circuits exhibit high insertion loss, low isolation, high VSWR or narrow frequency operation, all of which cause degraded device performance. Depending on the specific configuration of the device, improved operation is normally attained only at the expense of increased cost and complexity. Such devices have thus been useful under limited circumstances but have failed to be widely accepted for use in diverse environments. In microwave stripline technology in particular, commercially available hybrid couplers have included structures which enclose the coupling lines with dielectric material. As the amount of dielectric is increased, greater isolation is achieved but higher insertion losses are experienced. A reduction in the amount of dielectric improves insertion loss but reduces the isolation caused by mismatch in even-odd mode phase velocities. In any event, the operation of such devices over wide frequency ranges and large temperature variations could not be achieved without a tradeoff between insertion loss and isolation.

Accordingly, the present invention has been developed to overcome the specific shortcomings of the above known and similar techniques and to provide an air-stripline microwave coupler having improved coupling and operational characteristics.

SUMMARY OF THE INVENTION

In accordance with the present invention, an air-stripline formed on each of two dielectric substrates is configured to have a quarter wavelength overlay region. The striplines are vertically positioned with respect to one another so that each stripline overlays the other in that quarter wavelength region. The stripline substrates are retained by alignment pins projecting from a base portion and separated by spacers to control the air space between the two striplines. A plurality of spring washers bear against one of the stripline boards to maintain oontact of the boards with the spacers for accurate spacing control. A cover which cooperates with the base portion to form a housing is received by the alignment pins and bears against the spring washers to maintain the striplines in precise spaced relation. Intersecting channels are formed in the base and cover portions of the coupler to complete the stripline propagation channels.

It is therefore a feature of the invention to provide a microwave coupler having a simple and inexpensive design.

It is another feature of the invention to provide a microwave coupler which exhibits low insertion loss and high isolation.

It is a further feature of the invention to provide an air-stripline microwave coupler which easily interfaces with microwave circuitry.

Yet another feature of the invention is to provide a microwave coupler which exhibits resonant-free performance over a wide frequency range.

Still another feature of the invention is to provide a microwave coupler which is stable over its range of operation for a wide range of temperatures.

A further feature of the invention is to provide air-stripline microwave couplers which may be easily used as power combiners for a variety of microwave generating devices.

These and other novel features and advantages of the invention will become apparent from the following detailed description when considered with the accompanying drawings wherein:

DETAILED DESCRIPTION OF A PREFERRED EMBODIMENT

Figure 1:
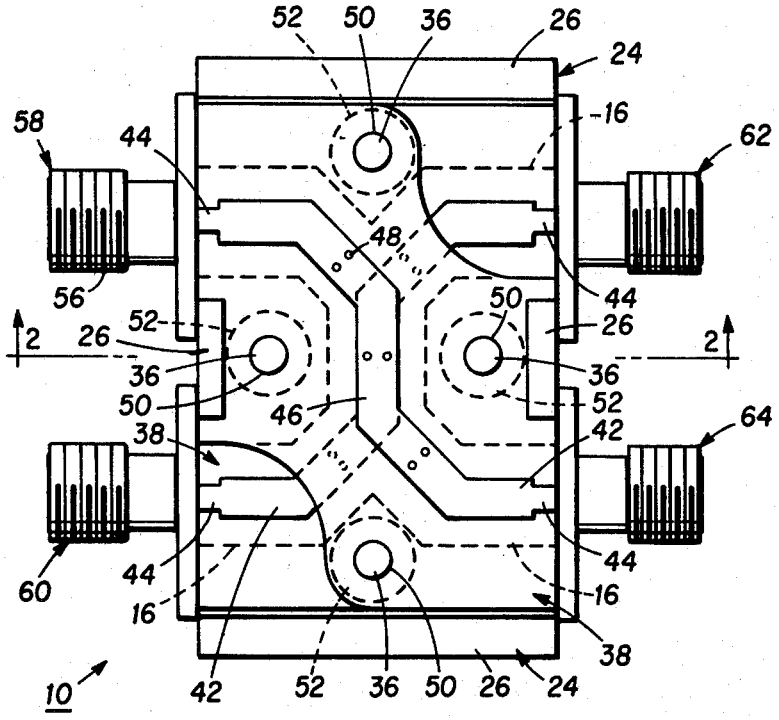
FIG. 1 is a top view of the inventive microwave coupler with the top cover removed.
Figure 2:
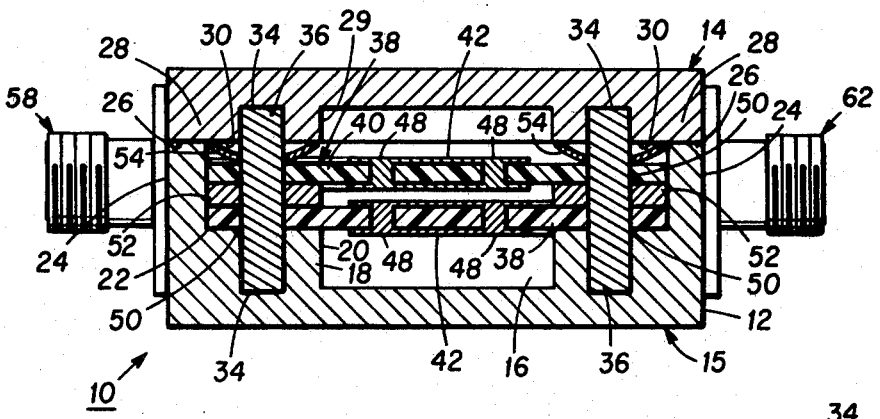
FIG. 2 is an end sectional view taken along line 2—2 in FIG. 1.
Figure 3:
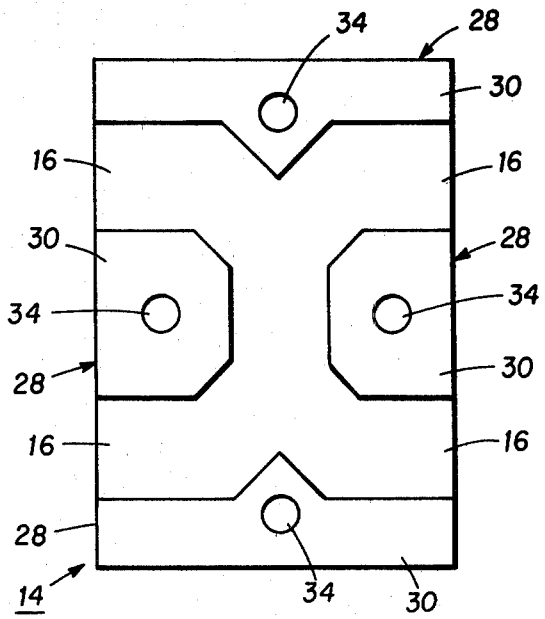
FIG. 3 is an inside view of the cover of the coupler which shows construction of the intersecting channels.

Referring now to the drawings, the inventive microwave coupler 10 is shown wherein like numerals are used to refer to like elements throughout the drawings. Referring first to FIG. 2 the microwave coupler 10 generally includes a base portion 12 and a cover portion 14 which cooperate to form a housing 15. The base or support plate 12 and cover 14 are made of any conventional electrically conductive material capable of forming a conductive ground plane as part of the coupler. In the present example, the base 12 and cover 14 may be machined or otherwise formed from a rectangular aluminum plate. Ihe base 12 and cover 14 are configured to have four intersecting U-shaped channels 16 which enclose the microwave transmission paths. The channels are formed to have a configuration which mirrors that of the air-stripline conductors 42 as more particularly shown in FIGS. 1 and 3 and as will be described below.

When the base 12 is formed with channels 16, pedestal portions 18 are also formed having side walls 20, which comprise the walls of channels 16, and upper planar surfaces 22. The base 12 also includes supporting members 24 which extend generally perpendicular to surfaces 22 along the width of the base plate 12 on each end and on each side from pedestals 18 and having an upper surface 26 for receiving the cover 14. The cover 14 also includes pedestal portions 28 having side walls 29 which form the walls of U-shaped channels 16 in the cover 14. The pedestals 28 include planar surfaces 30 on each pedestal portion 28 which mate with surfaces 26 of support 12 to complete the housing 15.

The base 12 and cover 14 include a plurality of openings 34 wherein one opening is located in each of the pedestals 18 and 28. The openings 34 receive alignment pins 36 in such a manner that the alignment pins extend from the surfaces 22 and 30 of the pedestals 18 and 28, respectively, and project substantially perpendicular to the base of support plate 12. The alignment pins may be constructed to have any of a variety of configurations and may be formed from any suitable material but in the present example, are formed as a metallic cylindrical pin extending from the opening 34 in pedestal 18 to a height above the surface 26 of support members 24. The alignment pins 36 are used to accurately and precisely position air-stripline boards 38 in a predetermined position, as will be described below, as well as to position the cover 14 in proper vertical alignment so that U-shaped channels 16 in both base 12 and cover 14 lie in vertical opposed parallel relation. As seen in FIGS. 1 and 2, the pins project from the raised pedestal portions 18 and 28 in suport plate 12 and lie adjacent to intersecting channels 16 approximately midway along each side of support 12 and cover 14.

The air-stripline conductors 42 which form the microwave transmission lines in the coupler 10 are formed on air-stripline boards 38 as more particularly shown in FIG 2. Each board 38 includes a dielectric substrate 40 of uniform thickness supporting electrically-conductive strips 42 of identical configuration in vertical alignment on opposite sides of the board 40. Electrically-conductive strips 42 are formed to have a configuration to form terminal portions 44 on opposite edges and at opposite ends of each board and are arranged to form a quarter-wave portion 46 which extends generally parallel to the length of the board 40. A plurality of plated-through holes 48 are located along the length of the strip 42 and interconnect the strips 42 on either side of the board 40. The plated-through holes 48 are spaced about one-quarter inch apart along the length of each strip and are designed to prevent microwave resonance during energy transmission and coupling. By way of example, the stripline boards 38 may be formed using conventional techniques herein one ounce copper strips of appropriate width are deposited to form the conductive strips 42 and are deposited on a ten mil dielectric board 40 formed of Teflon-fiberglass.

The microwave coupler of the present invention is formed using at least two air-stripline boards 38 in a vertically stacked arrangement over the alignment pins 36 on support plate 12. The boards 38 are formed to have openings 50 which receive alignment pins 36. In the present instance, one of the boards is positioned over the alignment pin 36 so that one surface of the board abuts the planar surfaces 22 of the pedestal portions 18 on support 12. In this position, the conductive strip pattern 42 lies vertically above the intersecting channel 16 and forms a path extending from a terminal portion 44 at one edge at one end of the support 12 to a terminal portion 44 at the opposite edge and opposite end of that same support 12 (FIG. 1). A second board 38 is constructed to have an air-stripline of identical configuration to the air-stripline of the first board but is oriented on the alignment pins 36 so that the conductive strip 42 has its terminal portions 44 reversed with respect to the first board so that the conductive patterns 42 lie above one another and, when viewed from above, form a generally X-like configuration following the channels 16 as shown in FIG. 1. The boards 38 are so positioned that the quarter-wave portions 46 are vertically aligned and parallel to one another along the length of the boards 38 and form an overlap area providing the coupling between the transmission lines. The resulting configuration forms a coupler with four terminals 44 creating the input/output ports for the device.

Referring again to FIG. 2, the proper spacing between the boards 38 is maintained by a plurality of spacing members 52 which are formed to have opposed flat parallel surfaces and an opening which receives alignment pins 36. Each spacing member 52 is of identical thickness and is positioned between each of the two boards 38 on the alignment pins 36 to precisely space the boards 38 a uniform distance from one another. A spring element 54 is located over each alignment pin 36 above the second board 38 so that one surface of the spring element 54 bears against the surface of the upper board 38. When the cover 14 is placed over the alignment pins 36 to complete the housing 15, the planar surfaces 30 bear against the spring elements 54 to force the upper board 38 against spacing element 52 which in turn is forced against lower board 38 to maintain forceful contact of the lower board with planar surfaces 22. In the present example, the metal spacers may be formed as metallic washers having a thickness of 15.9 mils. This particular separation maintains precision alignment of the boards 38 for optimal 3 dB quadrature coupling applications in a frequency range of 1–12 GHz.

As was previously noted, each of the terminal portions 44 form an input/output terminal for the coupler configuration and can be connected to appropriate transmission lines for receiving the microwave energy and distributing that microwave energy to other transmission lines or devices. In the present example, the terminal portions 44 could be coupled to conventional coaxial connectors 56 which are schematically shown in FIG. 1. Specifically, the connectors may be attached to the base 12 so that the outer coaxial conductor is electrically attached to the base 12 and the inner coaxial conductor is electrically connected to the terminal portion 44. The particular connectors and coupling arrangements for providing contact to terminal portions 44 are well known and will not be described in any further detail herein.

The operation of the system may now be understood with reference to FIGS. 1 and 2. More specifically, the support 12 receives air-stripline boards 38 which are positioned by spacers 52 on alignment pins 36 to maintain boards 38 so that the coupling portions 46 are located in a precise spaced, vertical parallel alignment. The coaxial connectors 56 are appropriately coupled to the support 12 and terminal portions 44 to provide electrical inputs and outputs at the terminals 44. In operation, microwave power is supplied to one of the terminals, which in the present instance will be referred to as input terminal 58. At the same time terminal 60 is terminated in a 50 ohm load. Terminals 62 and 64 then form output ports for providing the output from the 3 dB quadrature coupler formed by the above-described structure. The outputs from 62 and 64 may be coupled to conventional 50 ohm coaxial cables for further transmission or coupled to devices utilizing the microwave energy. As will be understood, the coupling at outputs 62 and 64 is provided from input 58 through the overlay region 46 which is separated solely by air. The intersecting channels 16 form transmission channels about the strips 42 and surrounding the strips 42 solely in the same air medium so as to form a 121 ohm even mode impedance in the overlay region. In the present example, using boards of the dimensions indicated, a 3 dB quadrature coupling is provided which operates over a frequency range of 6 to 12 GHz with a center frequency of 9.4 GHz. The coupler exhibits low loss and high isolation as well as low VSWR over that frequency band and specifically at 9.4 GHz. At 9.4 GHz there is a return loss of 17.5 dB, and isolation of greater than 25 dB and a total insertion loss of less than 0.25 dB. The coupler exhibits no degradation in performance after 5000 hours of temperature cycling between −55° C. and +75° C.

As can be seen from the above disclosure, a low cost quadrature coupler can be constructed using air-stripline circuit techniques. The device uses readily available materials and construction techniques, thereby enabling mass production and low cost assembly. The coupler is of simple design and construction which improves its reliability and versatility in connection with microwave devices. As previously noted, the coupler provides low loss and high isolation as well as resonant-free performance over a wide frequency range. All of these are advantages that are not taught or suggested by the prior art, In addition, although the microwave circuit described above has been disclosed as a 3 dB hybrid coupler, it is apparent that the same could also have coupling values other than 3.0 dB and could be used as a combining circuit as is well known in the art. It is also clear that the operational range of the coupler could be fixed in any range of the microwave region by modifying the length of the quarter-wave overlay region. While the invention has been described with reference to particular materials and configurations, it is also evident that other materials and configurations may be used to produce similar results. Further, although air has been described as the medium which separates the air-stripline conductors, any gas medium compatible with the above-described operation may be employed. Obviously many other modifications and variations are possible in light of the above teachings. It is therefore to be understood that within the scope of the appended claims the invention may be practiced otherwise than as specifically described.

What is claimed is:

1. A method of forming a power coupling comprising:

forming a pair of spaced electrically conductive groundplanes;

disposing a first transmission line, having an input, an output, and an overlay region electrically coupling said input and output, between said conductive groundplanes by forming electrically conductive strips of identical configuration on both sides of a first dielectric substrate and electrically interconnecting said conductive strips with plated-through holes through said first dielectric substrate;

disposing a second transmission line, having an input, an output, and an overlay region electrically coupling said input and output, between said conductive groundplanes by forming electrically conductive strips of identical configuration on both sides of a second dielectric substrate and electrically interconnecting the conductive strips on said second dielectric substrate with plated-through holes through said second dielectric substrate; and maintaining said first and second transmission lines in spaced relationship so that said overlay regions are in aligned, overlapping, parallel relationship for coupling microwave energy therebetween and separated from one another and from said groundplanes only by a gas medium.

2. The method of claim 1 wherein said step of maintaining includes the step of positioning a spacer of uniform thickness between said substrates to maintain said overlay regions in parallel relationship with respect to one another.

3. The method of claim 1 further including the step of forming one of said ground planes as an electrically conductive support and retaining said substrates on said electrically conductive support by alignment pins projecting from said support through said substrates.

4. The method of claim 3 further including the step of forming the other of said ground planes as an electrically conductive cover and placing said electrically conductive cover over said support on said alignment pins to enclose said substrates, said cover and support having intersecting channels which cooperate to form a transmission path surrounding said transmission lines.

5. In a microwave coupling circuit having coupling lines in proximity to one another between electrically conductive groundplanes for coupling microwave energy, the improvement in said circuit comprising:

first transmission means disposed between said conductive groundplanes to form at least one quarter wavelength region for transmitting microwave energy and including an electrically conductive strip deposited on a first dielectric substrate wherein each strip includes first and second strip portions of identical configuration deposited in opposed parallel relation on opposite sides of said first dielectric substrate and electrically interconnected by plated-through holes;

a second transmission means disposed between said conductive groundplanes and having a quarter wavelength region for transmitting microwave energy and including an electrically conductive strip deposited on a second dielectric substrate wherein the strip on said second dielectric substrate includes first and second strip portions of identical configuration deposited in opposed parallel relation on opposite sides of said second dielectric substrate and electrically interconnected by plated-through holes; and means for maintaining said regions of said first and second transmission means in spaced and overlapping relationship for coupling microwave energy therebetween, said transmission means being separated from one another and from said groundplanes solely by a gas medium.

6. The apparatus of claim 5 wherein each of said first and second transmission means includes first and second electrically conductive end portions coupled to said region, said first and second end portions forming the inputs and outputs for the coupling circuit.

7. A microwave power circuit comprising:

a planar electrically conductive support having four channels intersecting one another centrally of said support, each of said channels being separated by a pedestal portion of uniform height;

an alignment pin projecting from each of said pedestal portions;

a first transmission means having openings for receiving said alignment pins to position a first transmission line parallel to said planar support and spaced from selected ones of said channels, said first transmission line including a first terminal, a second terminal, and an overlay portion electrically connecting said first and second terminals;

a second transmission means having openings for receiving said alignment pins to position a second transmission line in predetermined relationship to said first transmission line, said second transmission line including a first terminal, a second terminal, and an overlay portion electrically interconnecting said first and second terminals, said openings in said second transmission means being configured to position said overlay portion of said second transmission line in overlapping relationship with respect to the overlay portion of said first transmission line;

means for spacing said first and second transmission means so that the transmission lines are separated solely by an air medium and the overlay portions are maintained in parallel relationship;

an electrically conductive cover having openings for receiving said alignment pins and cooperating with said support to form a housing enclosing said transmission means, said cover including intersecting channels having a configuration identical to those in said support and cooperating to form transmission paths through said housing.

8. The apparatus of claim 7 wherein said first and second transmission means each include an electrically conductive strip deposited on a dielectric substrate wherein each strip includes first and second strip portions of identical configuration deposited in opposed parallel relation on opposite sides of said dielectric substrate and electrically interconnected by plated-through holes.

9. The apparatus of claim 8 wherein said plated-through holes are spaced along said strips to prevent resonance during energy transmission.

10. A microwave circuit comprising:

a rectangular electrically conductive planar support plate having four U-shaped channels intersecting one another centrally of said support plate, each of said channels being separated by a raised pedestal portion located midway along each side of said support plate, each of said pedestal portions being formed of uniform height with respect to all other pedestal portions;

an alignment pin projecting from each pedestal portion substantially perpendicular to said support plate;

a first air-stripline board received by said pins and uniformly spaced above said support plate by said pedestal portions, said air-stripline board having an electrically conductive strip having a first end portion and a second end portion electrically interconnected by a quarter-wave overlay region, said conductive strip being configured to extend from an edge of the board at one end of said support plate to an opposite edge of the board at the other end of said support plate;

a plurality of spacer elements having openings for receiving an alignment pin, each of said spacer elements being of uniform thickness and being located one on each of said alignment pins for abutting said first air-stripline board;

a second air-stripline board received by said pins and uniformly spaced parallel to said first air-stripline board by said spacer elements, said second air-stripline board including an electrically conductive strip having first and second end portions electrically interconnected by a quarter-wave overlay region overlapping and spaced parallel to said overlay region of said first air-stripline board, said conductive strip of said second air-stripline board having a configuration which is the reverse of the conductive strip on said first air-stripline board;

a plurality of spring washers having openings receiving said alignment pins, one of said washers being located in abutting relationship to said second air-stripline board on each alignment pin;

an electrically conductive rectangular cover plate having four U-shaped channels intersecting one another centrally of said cover and having a configuration identical to the configuration of U-shaped channels in said support plate, each of said channels being separated by a raised pedestal portion located midway along each side of said support plate and each of said pedestal portions having an opening therein for receiving said alignment pins to position said channels opposed to the channels in said support plate for forming a housing enclosing said air-stripline boards and channels surrounding said electrically conductive strips on said boards; and connector means coupled to the first and second end portions of said electrically conductive strips on each of said boards and coupled to said support plate for providing electrical connections to said conductive strips, said conductive strips of each air-stripline board being surrounded solely by air in said channels and between said air-stripline boards.

11. The apparatus of claim 10 wherein each electrically conductive strip comprises two electrically conductive strip portions, one deposited on either side of a dielectric substrate of uniform thickness to form said air-stripline board, said electrically conductive strips being electrically interconnected by plated-through holes spaced along the length of each strip to prevent resonance.

* * * * *